US008011857B2

(12) United States Patent
Foo et al.

(10) Patent No.: US 8,011,857 B2
(45) Date of Patent: Sep. 6, 2011

(54) EXTRACTION SYSTEM FOR REMOVABLE MARINE FOOTING

(75) Inventors: Kok Seng Foo, Singapore (SG); Chin Kau Quah, Singapore (SG); Okky Ahmad Purwana, Singapore (SG); Yean Khow Chow, Singapore (SG); Chun Fai Leung, Singapore (SG)

(73) Assignees: Offshore Technology Development Pte Ltd, Singapore (SG); National University of Singapore, Singapore (SG)

( * ) Notice: Subject to any disclaimer, the term of this patent is extended or adjusted under 35 U.S.C. 154(b) by 207 days.

(21) Appl. No.: 12/472,357

(22) Filed: May 26, 2009

(65) Prior Publication Data

US 2009/0269144 A1 Oct. 29, 2009

Related U.S. Application Data

(63) Continuation-in-part of application No. 11/467,149, filed on Aug. 24, 2006, now abandoned.

(30) Foreign Application Priority Data

Sep. 13, 2005 (SG) ..... 200505850-8

(51) Int. Cl.
*E02D 9/02* (2006.01)

(52) U.S. Cl. ..... 405/224.1; 114/297

(58) Field of Classification Search ..... 405/224, 405/224.1, 226, 203; 114/294–297
See application file for complete search history.

(56) References Cited

U.S. PATENT DOCUMENTS

| | | | | | |
|---|---|---|---|---|---|
| 2,774,218 | A | * | 12/1956 | Hazak | 405/226 |
| 2,994,202 | A | * | 8/1961 | Knapp et al. | 405/224 |
| 4,086,866 | A | | 5/1978 | Nixon | |
| 4,572,304 | A | | 2/1986 | Mahar | |
| 4,761,096 | A | | 8/1988 | Lin | |
| 5,259,458 | A | * | 11/1993 | Schaefer et al. | 166/335 |

* cited by examiner

*Primary Examiner* — Sunil Singh
(74) *Attorney, Agent, or Firm* — Pyprus Pte Ltd

(57) ABSTRACT

The present invention describes an extraction system (100, 100*a*) for expediting removal of a footing (105) that is embedded in a seabed or marine floor. The extraction system provides a supply of pressurized fluid (140) to a chamber from where the pressurized fluid exudes through porous members (122,122*a*, etc) located on the base (114) of the footing (105). When an uplifting force is applied to the footing (105) for its removal, the pressurized fluid (140) exudes out through the porous member (122,122*a*, etc.) to compensate or reduce suction induced beneath the footing, without fluidizing or channeling of the seabed soil, thereby expediting removal of the footing (105).

13 Claims, 6 Drawing Sheets

EXTRACTION SYSTEM FOR REMOVABLE MARINE FOOTING

RELATED APPLICATION

The present invention is a continuation-in-part of, and claims priority to, U.S. patent application Ser. No. 11/467,149 filed on Aug. 24, 2006, which has been abandoned, the disclosure of which is herein incorporated in its entirety.

FIELD OF INVENTION

The present invention relates to an extraction system for removing marine footings, such as those footings and foundations used on legs of mobile offshore rigs.

BACKGROUND

Offshore structures, such as those used for drilling and production of hydrocarbons as well as for generating renewable energy, in relatively shallows waters are typically supported by footings or foundations embedded in the seabed. Some of these footings are permanent whilst others are designed to be removable. For example, a modern rig for oil and gas drilling and well operations is usually mobile and its footings must then be removable. A typical mobile drilling rig for use in up to 120 m water depth has three supporting legs, with each leg being operable to be lowered or retracted independently through a jacking system located on its hull. The base of each leg comprises a shallow foundation or footing known as "spudcan". The hull of the rig consists of ballast tanks, into which sea water is pumped to preload the rig and to allow the footings to penetrate into the seabed. Conventionally, the footings of some drilling rigs are equipped jetting nozzles, which are supplied with high pressure water from high pressure pumps; water jets from the nozzles loosen and fluidise the sandy seabed material during installation or removal of the footings. These conventional water jetting systems are notably applicable for liquefiable material such as sandy soil but has very limited effectiveness for cohesive soils such as clay.

FIG. 1A shows a known anchoring device by Nixon (see U.S. Pat. No. 4,086,866). The anchoring device is equipped with such conventional water jetting nozzles but has additional suction passageways. By supplying fluidizing water from the nozzles located near the lower part of the anchoring device and applying suction to the suction passageways, the seabed material immediately below the anchoring device is turned into a suspension, which is then pumped away through the suction passageways so that the anchoring device buries itself into the seabed.

FIG. 1B shows a known fluid actuated excavation system for installing sub-sea structures (see U.S. Pat. No. 5,259,458 issued to Schaefer). By providing a fluid stream from the top of a structure to the base, where a plurality of nozzles are terminated, jets of fluid ejecting from the nozzles excavate the installation area, thereby allowing the base of the structure to sit below the seabed. According to U.S. Pat. No. 4,086,866, this fluid excavation system is effective for seabed with sandy and granular material. In both U.S. patents, they disclose the use of fluidization of the seabed to install sub-sea structures but the effectiveness of the method for removing the embedded structures from the seabed is not discussed.

FIG. 2 shows another known fluid actuated excavation system for installing a footing into the seafloor and for its removal (see U.S. Pat. No. 4,761,096 issued to Lin). By providing internal jetting in a footing to shoot water out of nozzles, the surrounding seabed soil is fluidized and the seabed soil is thus loosened for the footing to penetrate into the seabed or for the footing to be pulled out. Preferably, the nozzles are directed at an angle so that the water jets are tangential to the footing's surface and this helps in removing soils away from the bottom of the footing. Despite being applicable for removing a footing that is embedded in the seabed, typically sandy seabed does not generate significant pulling resistance; this can be attributed to relatively shallow penetrations and high soil permeability; water jetting application thus is not instrumental for footing removal in such sandy soil conditions.

Despite development in the art of installing or retrieving a footing of a marine structure by fluidizing the seabed soil, there is a need for a new type of extraction system for relocating mobile marine structures, especially those structures that are installed in cohesive soil.

SUMMARY

The following presents a simplified summary to provide a basic understanding of the present invention. This summary is not an extensive overview of the invention, and is not intended to identify key features of the invention. Rather, it is to present some of the inventive concepts of this invention in a generalised form as a prelude to the detailed description that is to follow.

The present invention seeks to provide a system for extraction of a footing or foundation that is embedded in a seabed or marine floor. The footing or foundation can be an extensive base, a spudcan, a caisson or skirted base but in contrast with conventional soil excavation systems, the present system does not rely on fluidization of the seabed soil. This system is thus also effective for removing a footing that is embedded in cohesive soil.

In one embodiment, the present invention provides an extraction system for removing a removable footing of a marine structure. The extraction system comprises: a pump for supplying pressurized fluid to a chamber disposed in said footing; and a plurality of spaced apart outlets associated with the chamber such that the outlets are formed on a base of said footing that bears on the marine floor on which the marine structure is supported. Each outlet has a porous member disposed across its opening, said porous member has a predetermined porosity and a predetermined surface area, such that the pressurized fluid is operable to exude out of the surface area of the porous member, without fluidizing or channeling the soil beneath the footing, to form a film or layer of pressurized fluid between the base external of the footing and the soil for reducing negative soil excess pore pressure when an uplifting force is applied to the footing during extraction of the marine structure. This eases the induced suction at the base of the footing and expedites removal of the marine structure.

In another embodiment, the chamber comprises a plurality of chambers, with each chamber being associated with an outlet. A fluid distribution pipe or pipes may supply the chamber or each of the plurality of chambers. The pressurized fluid may be water or air.

In one embodiment, the plurality of chambers are formed inside of the base of the footing; in another, the plurality of chambers are formed outside of the base of the footing. The porous member at each outlet has a predetermined porosity and predetermined surface area. The porous member is sized and dimensioned so that it has the strength and rigidity to withstand the pressurized fluid and soil bearing pressure. The porosity of a porous member may vary through its thickness so that the pressure loss is minimal. Preferably, the porous member is with open pore structures by bonding or welding layers of metallic wire meshes or woven wire cloths together.

BRIEF DESCRIPTION OF THE DRAWINGS

This invention will be described by way of non-limiting embodiments of the present invention, with reference to the accompanying drawings, in which.

DETAILED DESCRIPTION

Figure 1A:
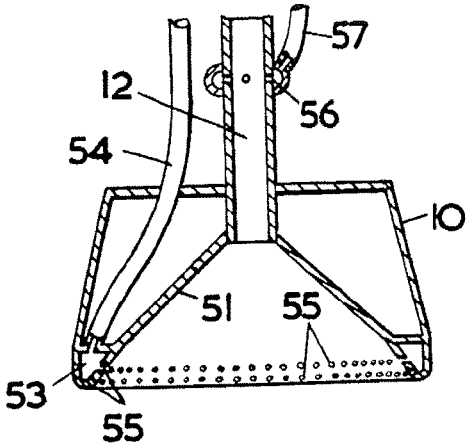
FIG. 1A (Prior Art)
FIGS. 1A and 1B illustrate known suction systems for installing an anchoring device and sub-sea well-head protection unit, respectively, in non-cohesive granular type seabed, such as sand or gravel, and soft mud.

One or more specific and alternative embodiments of the present invention will now be described with reference to the attached drawings. It shall be apparent to one skilled in the art, however that this invention may be practised without such specific details. Some of the details may not be described at length so as not to obscure the invention. For ease of reference, common reference numerals or series of numerals will be used throughout the figures when referring to the same or similar features common to the figures.

Figure 3A:
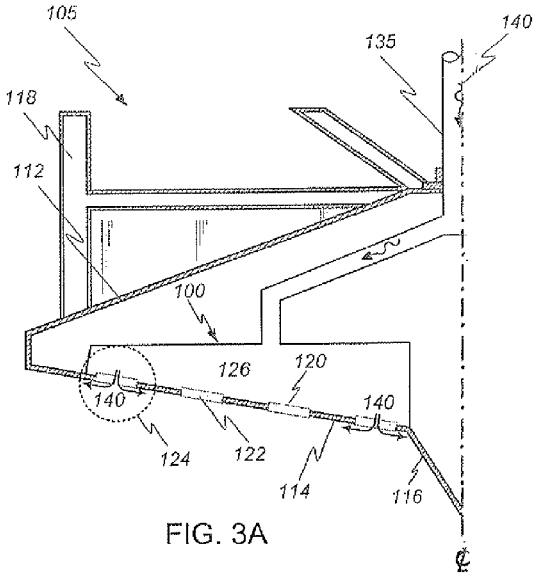
FIG. 3A illustrates a cross-sectional view of a symmetrical half of a footing according to an embodiment of the present invention.

FIG. 3A shows an extraction system 100 being integrated into a footing or foundation of a removable marine structure according to an embodiment of the present invention. As shown in FIG. 3A, the footing or foundation 105 is made up of a conical base or a spudcan 110 and trusses 118 at an end of a leg of the removable marine structure. The spudcan 110 has a substantially conical upper surface 112 and a substantially inverted conical lower surface 114. Near the centre of the lower surface 114, there is a conical spigot 116, which is typically provided to pin the footing 105 into the seabed or marine floor during the initial stage of installation. As shown in FIG. 3A, the lower conical surface of the spudcan 110 or footing 105 has a plurality of spaced apart openings 120. Each opening 120 has a porous member 122 disposed across the opening and each assembly forms an outlet 124 unit. The inside of the outlets 124 lead to a chamber 126 into which pressurized fluid 140, such as water or air, is fed through pipes 130, 135 by a pump. The pump may be a high-pressure water pump or a pneumatic compressor, which is operable to supply the pressurized fluid at a pressure up to about 100 bar (1500 psi). The pump/compressor may be a centrifugal, piston, vane or gear type. The pump/compressor is typically located on a hull or platform of the marine structure but is not shown in the figure. In a variation, the pipe 135 may lead to a number of smaller distribution pipes 130 that feed into the chamber 126.

Figure 1B:
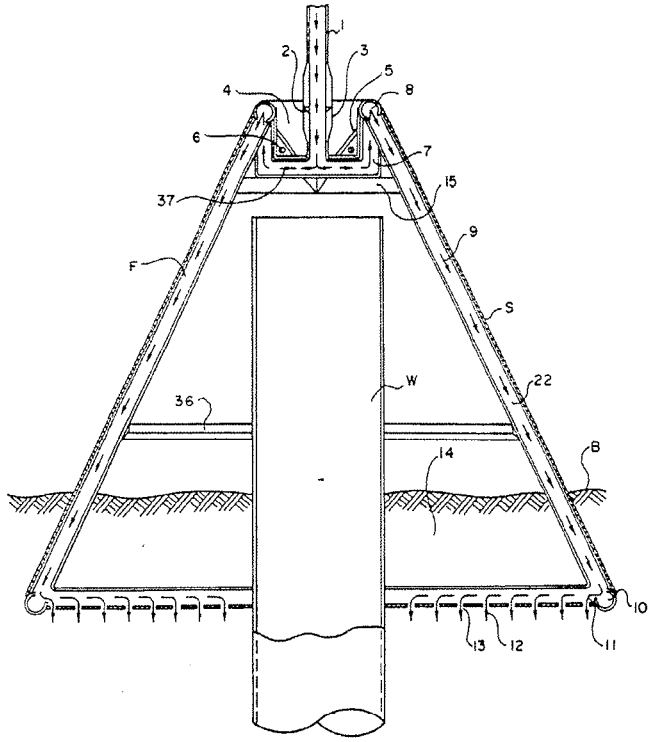
FIG. 1B (Prior Art)
Figure 2:
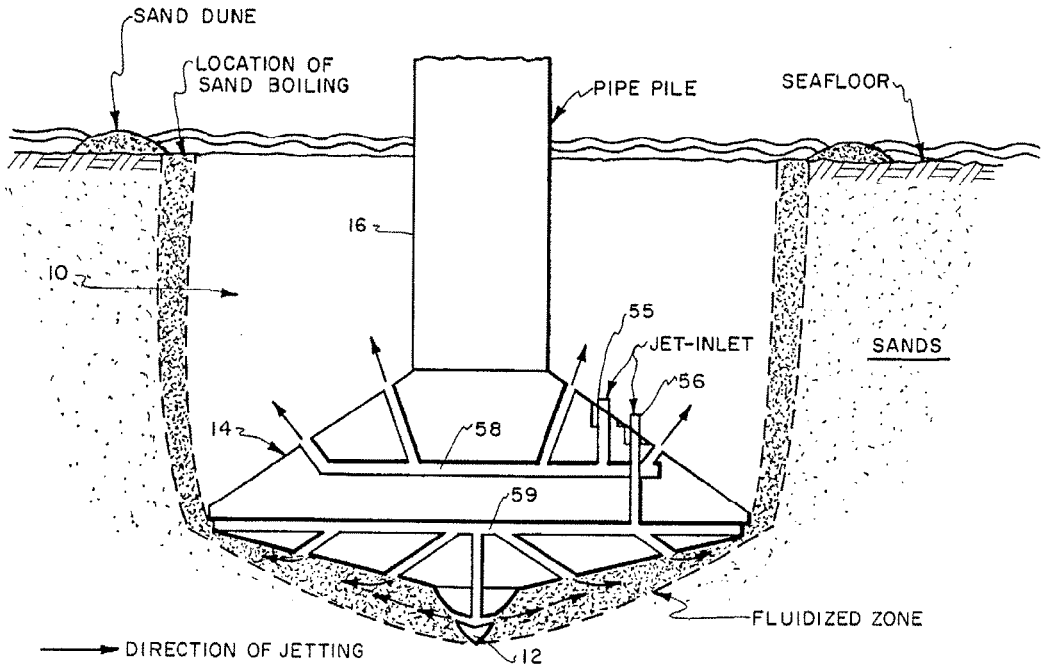
FIG. 2 (Prior Art)
FIG. 2 illustrates a known jetting system for installing and removing a footing of a marine structure that is embedded in liquefiable seabed material, such as sand and silt.
Figure 3B:
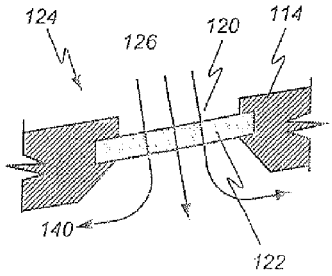
FIG. 3B illustrates a sectional view of an outlet on the footing shown in FIG. 3A.

FIG. 3B shows a section view of the outlet 124 shown in FIG. 3A. As shown in FIGS. 1A, 1B and 2, each conventional jet nozzle is made up of an open-ended pipe, which is typically 38-76 mm (1.5-3 inches) in diameter. In contrast, each opening 120 or outlet 124 of the present invention has a predetermined surface area that is significantly larger than the cross-sectional area of the typical 38-76 mm diameter pipe. In aggregate, the total surface area of the openings 120 or outlets 124 constitutes a percentage, for example, ranging from about 1% to about 10% of the footing's base area 114; such footing base area typically ranges from about 100 to about 300 $m^2$. With an even distribution of the outlets on the base area, this allows the pressurized fluid from the chamber 126 to diffuse out of the openings 120/outlets 124 to form a substantially uniform layer or film of fluid at the interface between the base area 114 and the surrounding soil. Preferably, the layer or film of fluid exuding from a porous member 122 spread and join the layer/film of fluid from adjacent porous members to form an extensive layer/film of fluid below the base of the footing 105. The layer or film of fluid at the interface between the footing base area 114 and surrounding soil acts as a buffer layer to reduce or compensate for suction induced in pores of the soil underneath the footing 105 during its removal. Suction developed at the base of the footing 105 is induced by transfer of uplift force from the hull to the footing 105/spudcan 110, thereby causing the pore water pressure at the footing base 114 to drop below the corresponding hydrostatic pressure. In order not to impede the uplift of the footing, the induced suction at the base of the footing must be reduced. The approach in the present invention is to supply the pressurized fluid layer/film to the base area so that the pore pressure at the base of the footing is less negative and preferably is higher than the hydrostatic pressure. At the same time, the pressurized fluid exudes through the porous members 122 gently and evenly without loosening, fracturing or channeling the underlying soil. The present invention is thus suitable for extracting a footing 105 that is embedded in a seabed or marine floor and is more effective than conventional soil excavation/fluidization system. The other advantage is its use for removing a footing 105 that is embedded in cohesive soil, such as clay. In contrast, the nozzles of conventional excavation/fluidization system create water jets that loosen and fluidize the surrounding soil, and the loosened soil is moved by mass flow from the bottom of the footing, as can be clearly seen in FIG. 2. In cohesive soil, such as clay, soil channeling or fracturing (instead of fluidization) occurs when water ejects from the nozzles. When soil channeling occurs, localized water channels are formed at only some of the conventional nozzles and the pressure at the other nozzles drop, thus resulting in ineffective pressure distribution across the footing base 114.

In use, the chamber 126 forms a reservoir of pressurized fluid 140 and the chamber 126 has a predetermined capacity such that the pressure of the fluid 140 in the chamber is maintained constant for a predetermined flow rate through the porous members 122 just like the capacitance of a capacitor in an electric circuit or the accumulator in a pneumatic system.

Figure 4A:
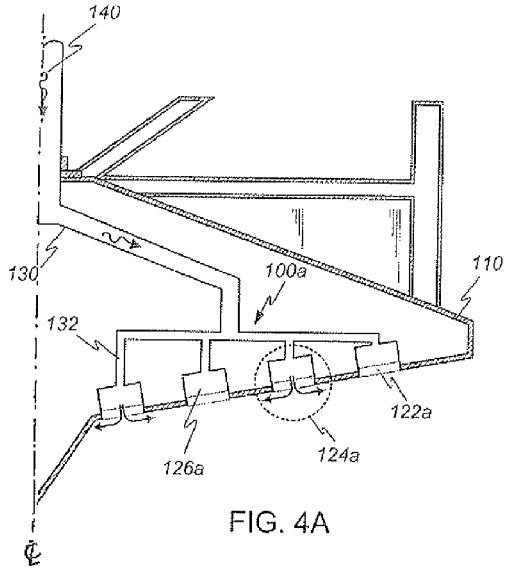
FIG. 4A illustrates a cross-sectional view of a symmetrical half of a footing according to another embodiment of the present invention.

FIG. 4A shows another extraction system 100*a* according to another embodiment of the present invention. As shown in FIG. 4A, the extraction system 100*a* is similar to the above extraction system 100 except that each outlet 124*a* has its own localized chamber 126*a*. Each localized chamber 126*a* is connected to the pipe 130 by a conduit 132. The localized chamber 126*a* maintains a constant pressure in the fluid 140 flowing through the porous members 122*a*. In a variation, a localized chamber 126*a* may serve a number of outlets 124*a*. In addition, the pipe 135 may also lead to a number of distribution pipes 130 and a number of conduits 132.

Figure 4B:
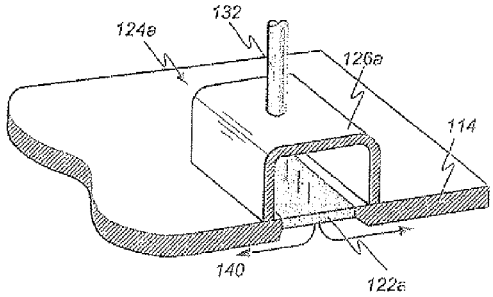
FIG. 4B illustrates a sectional view of an outlet on the footing shown in FIG. 4A.

FIG. 4B shows a perspective view of the outlet 124*a* shown in FIG. 4A. As shown in FIG. 4B, each localized chamber 126*a* is formed by a shell on the inside of the base surface 114 of the footing 105. Pressurized fluid is supplied by the conduit 132 through a face of the shell and the porous member 122*a* is disposed across the opening 120 on the base surface 114 that is covered by the shell.

In the above embodiments, the porous members 122, 122*a* are arranged so that the external surfaces are substantially flush with the exterior of the base surface 114. The external surface of the porous members 122, 122*a* is subjected to the full bearing pressure from the surrounding soil.

Figure 5A:
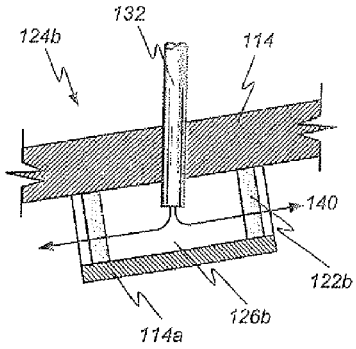
FIG. 5A illustrates a sectional view of an outlet on a footing according to another embodiment of the present invention.
Figure 5B:
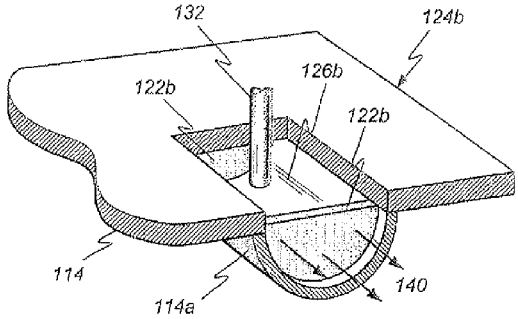
FIG. 5B illustrates a perspective view of the outlet shown in FIG. 5A.

FIG. 5A shows a sectional view of an outlet 124*b* for use with the footing/foundation 105 of a mobile offshore structure according to another embodiment of the present invention. FIG. 5B shows a cut-out view of the outlet 124*b* shown in FIG. 5A. As shown in FIGS. 5A and 5B, the outlet 124*b* projects out from the lower surface 114 of the spudcan 110 or footing 105. As shown in FIG. 5B, the projected surface 114*a* of the outlet 124*b* is formed by a substantially semi-cylindrical shell and each of the two open ends of the semi-cylindrical shell is covered by a porous member 122*b*. The porous member 122*b* is substantially perpendicular to the base surface 114. In this embodiment, the porous member 122*b* is subjected to a lower bearing pressure than the above porous members 122, 122*a* as most of the direct bearing pressure is taken up by the semi-cylindrical shell and the base surface 114.

Figure 5C:
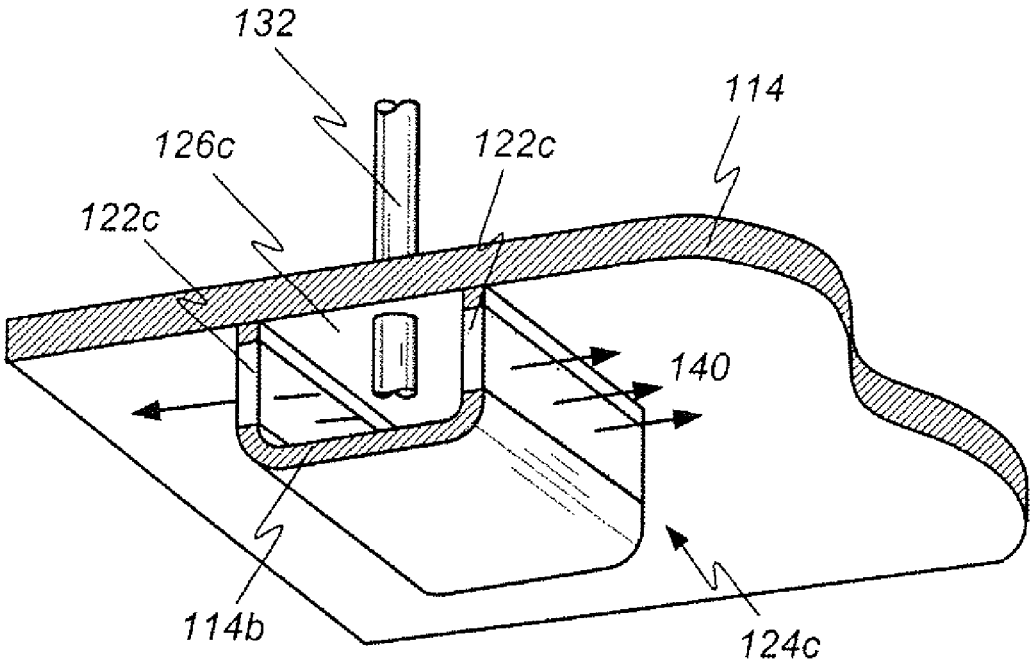
FIG. 5C illustrates a variation of the outlet shown in FIG. 5B.

FIG. 5C shows a sectional view of an outlet 124*c* according to another embodiment of the present invention. As shown in FIG. 5C, outlet 124*c* is similar to the outlet 124*b* except that the projected surface 114*b* of the outlet 124*c* is formed by a substantially U-shaped cylindrically shell and the porous member 122*c* is arranged on each of the two longitudinal sides to provide a larger area for the pressurized fluid 140 to exude out of each outlet 124*c*. The end faces of the U-shaped cylindrical shell are closed, but this is not shown in FIG. 5C. In another embodiment (not shown by a figure), each of all the sides of the U-shaped cylindrical shell has a porous member fitted thereon. In a variation, the shell forming the outlet 124*c* may take on other prismatic shapes, such as part of a hexagon. In another variation, the shell forming the outlet 124*c* can also be made by forming the porous member into a 3-dimensional shell.

Figure 7A:
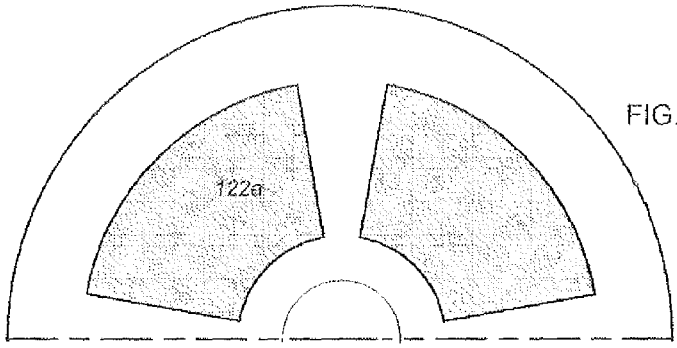
FIGS. 7A-7B illustrate spatial layouts of the outlets according to another embodiment of the present invention.
Figure 7B:
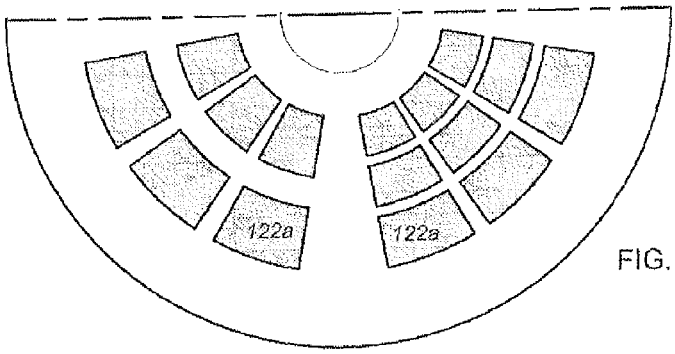

Referring back to FIGS. 3A and 3B, the porous members 122, 122*a* can be made into any shape; they may be round, quadrilateral or polygonal in shapes, formed into arcuate strips or 3-dimensional shapes. The porous members 122, 122*a* are spatially distributed on the lower surface 114 of the spudcan 110 or footing 105; the distribution may take any pattern; they may be arranged in a concentric or radial manner and so on. FIGS. 6A-6D show some possible shapes of the porous members and their distributions. FIG. 7A shows an entire sector of the lower surface 114 is covered by a plurality of porous members 122*a* that are arranged in butt contact with adjacent porous members to appear like a single porous layer, whilst FIG. 7B shows a sector of the lower surface 114 is covered with a plurality of spaced apart porous members 122, 122*a*, etc. As in the above embodiments, each outlet 124, 124*a* formed by a porous member may be supplied with pressurized fluid from a plurality of conduits 132. In one embodiment, each porous member 122, 122*a*, etc. is secured in a respective opening 120 by means of bolts; in another, each porous member is secured in a respective opening by means of adhesive, such as, high performance epoxy; in yet another embodiment, the porous members are secured in the respective opening 120 by a groove and lock mechanism. The lock may be bolted or welded onto the base surface 114 of the footing. If the porous member is metallic, it can also be welded onto the base 114 of the footing 105.

Figure 5D:
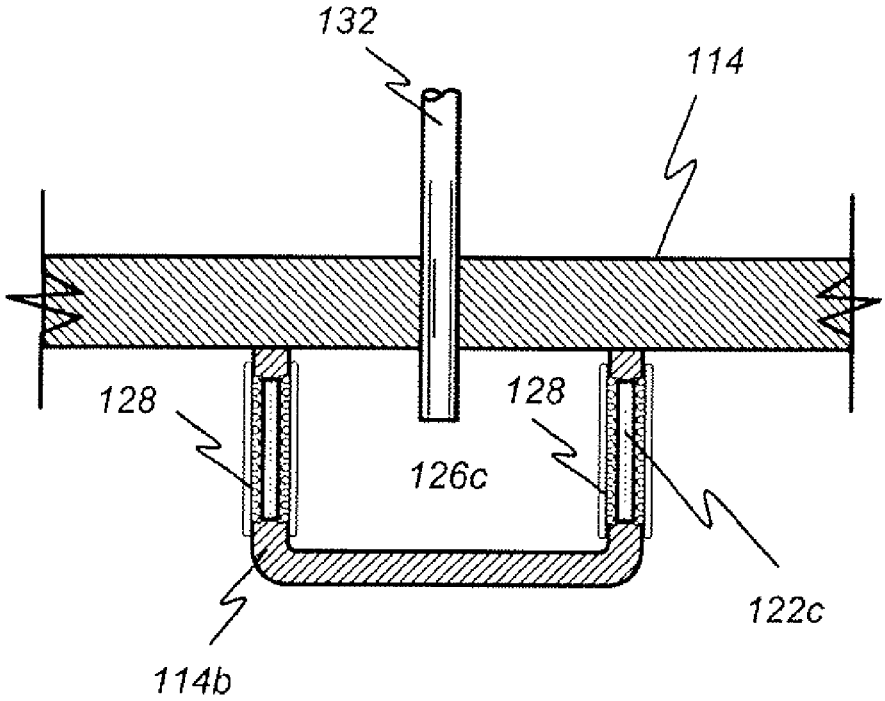
FIG. 5D illustrates a porous member that is structurally reinforced.
Figure 6B:
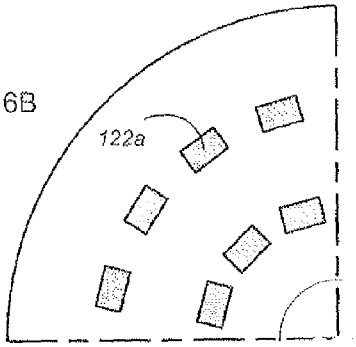
FIGS. 6A-6D illustrate spatial layouts of the outlets corresponding to the above figures.
Figure 6A:
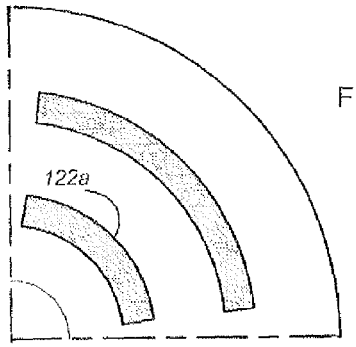
Figure 6D:
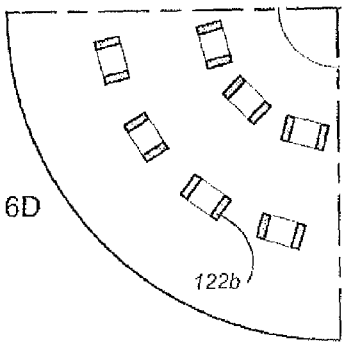
Figure 6C:
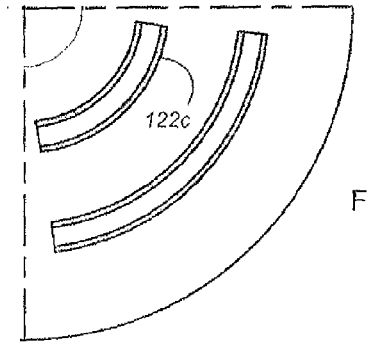

In one embodiment, the porous member 122, 122*a*, 122*b*, 122*c* is made from metallic wire mesh. In another embodiment, the porous members are made by sintering powdered metal; in another, the porous layer is made of ceramic; in yet another; the porous member is made by binding sand particles in an epoxy matrix. When the porous member is non-metallic, the porous member is structurally reinforced 128, as shown in FIG. 5D, to withstand stresses caused by the pressurized fluid and/or bearing pressure from the external soil. When the porous member is metallic, corrosion resistance in sea water is another factor for its selection; as examples, stainless steel 316, Inconel, Monel (Inconel and Monel are tradenames of Special Metals Corporation) and Hastelloy (being a tradename of Haynes International) are suitable corrosion resistant metals; ferrous metals that are surface plated or treated for corrosion resistance, for example by galvanizing, may also be used. For both non-metallic and metallic porous members, each member is sized and dimensioned so that it has the tensile strength and rigidity to withstand the bending and bearing stresses. Other factors to consider when designing the porous member 122, 122*a*, etc. are: i) designed porosity or permeability; ii) fluid flow rate; iii) applied pressure; iv) pressure loss; and v) bearing pressure.

In one embodiment, the porosity of the porous member 122, 122*a*, etc. varies across its thickness. Preferably, the porosity and pore sizes of the porous member decreases from the inner chamber 126, 126*a*, etc. side to the side facing the exterior of the footing 105. In another embodiment, the porous member 122, 122*a*, etc. is made up of two integral layers, with the inner layer having larger porosity and pore sizes than the outer layer. In a variation, the porous member 122, 122*a*, etc. is made up of a plurality of integral layers, with the porosity of the layers decreasing from the inner layer to the outermost layer. By forming the porous member with varying porosity and pore sizes through its thickness, the pressurized fluid 140 is operable to flow through the thickness of the porous member with minimal pressure loss or drop yet the porous members are operable to trap soil particles on the outer surface of the porous members for easy cleaning. For example, when the porous member 122, 122*a*, etc. is made from metallic wire mesh, a number of layers of wire meshes with different porosity are diffusion bonded to form an integral block with a thickness, adequate strength and rigidity yet having an open pore structure. In another example, a number of metallic wire meshes can be stacked between two flat electrodes and welded by passing a current through the electrodes; the porous member 122, 122*a*, etc after being formed may then be treated for corrosion resistance, for example by galvanizing. In another example, woven wire cloth may similarly be bonded or welded together to form a rigid, self-supporting porous member that is functionally different from a strainer. The porous members made from wire meshes having open pore structure are preferred over closed pores in porous sintered metal, sintered plastic, ceramic, or sand in epoxy. In practice, a soil sample is obtained and laboratory tests are carried out to determine the actual soil type; porosity and permeability of the porous members are then determined for use with the actual soil type. Specifying pore sizes to be smaller than soil particles may not be an optimum solution.

Figure 8A:
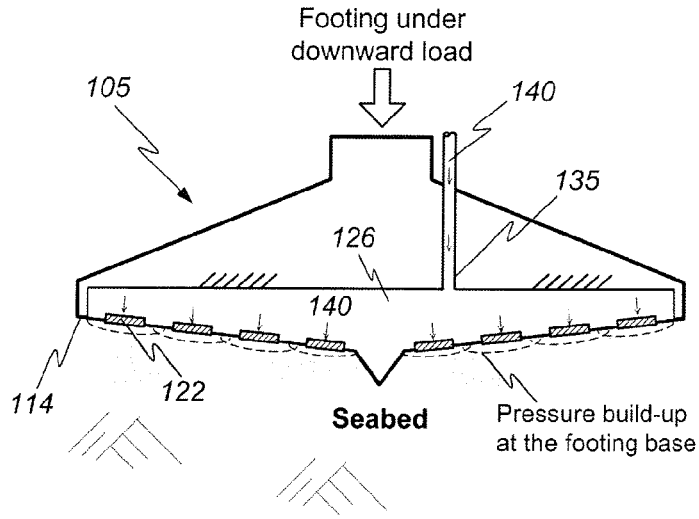
FIGS. 8A-8C illustrate the mechanism of the above extraction system according to yet another embodiment of the present invention.
Figure 8B:
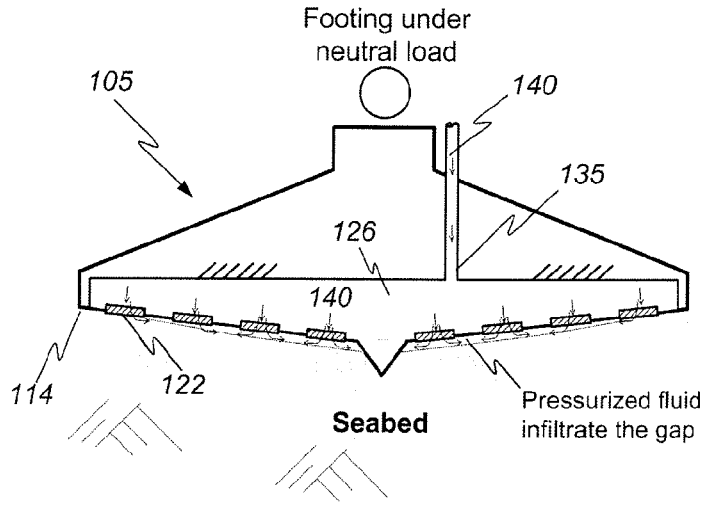
Figure 8C:
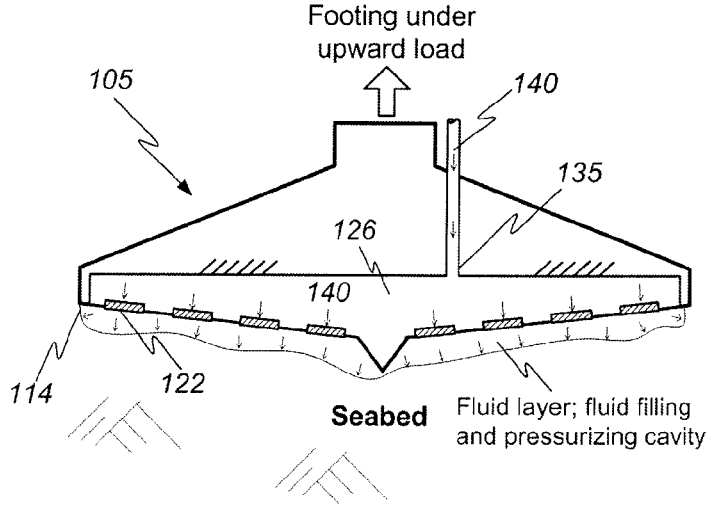

FIGS. 8A-8C illustrate the mechanism of the extraction system according to the present invention. In the following description, we assume that there is no soil resistance at the upper surface 112 of the footing 105. Immediately upon supplying pressurized fluid into the chamber 126, 126*a*, etc. next to the inner face of the porous member 122, 122*a*, etc., some increase in pore water pressure at the base external surrounding the outlets is generated with little or no fluid flowing out of the chamber. In this instance, the footing or foundation 105 is still subjected to some compressive load (see FIG. 8A) transmitted from the hull in elevated condition. In FIG. 8B, when the hull is jacked down to its floating draft, the marine structure is brought to neutral buoyancy resulting in low bearing stress acting on the lower surface 114 of the footing 105, the fluid 140 flow rate through the porous members starts to increase and a fluid film begins to spread more extensively and evenly across the lower surface of the footing 105. This can be attributed to the pressurized fluid 140 being able to infiltrate the interface between the lower surface 114 of the footing 105 and the soil immediately underneath the footing. At this juncture, the thin layer of fluid separates the lower surface 114 from the soil below. Differential pressure between the chamber and base external assists in generating fluid flow through the porous members 122, 122*a*, etc. The nature of the porous members facilitates the fluid transfer caused by pressure difference between upstream and downstream with minimizing potential of fracturing or channeling the surrounding soil as opposed to conventional jetting nozzles. An optimum arrangement of the outlets and porous members ensure uniform distribution of pressure and fluid flow across the lower surface 114 of the footing 105.

FIG. 8C illustrates the subsequent stage during which the footing 105 is subjected to an uplifting or pulling load during its removal. At this point, the hull may be further jacked down into the water to give some buoyancy and to create the uplifting/pulling load to the footing 105. The pull out load causes further drop in pore water pressure at the base 114 external but results in more differential pressure across the porous members 122, 122*a*, etc. In this instance, more fluid is drawn from the chambers 126, 126*a* to the fluid film outside the porous members 122, 122*a*, etc. so that the pressure of fluid film neutralizes the induced suction force. The effective pressure inside the fluid film is expectedly higher than the corresponding hydrostatic pressure and thereby creating a pushing force on the lower surface 114 of the footing 105. The fluid film grows in thickness as the footing 105 is being extracted and eventually a fluid-filled cavity is formed beneath the footing. If the pressure can be maintained below soil fracturing limit, that is, no fluid is lost through channeling, the displacement of the footing 105 under the pulling load is proportional to the volume of pressurized fluid 140 supplied to the fluid film outside the footing 105.

Figure 9A:
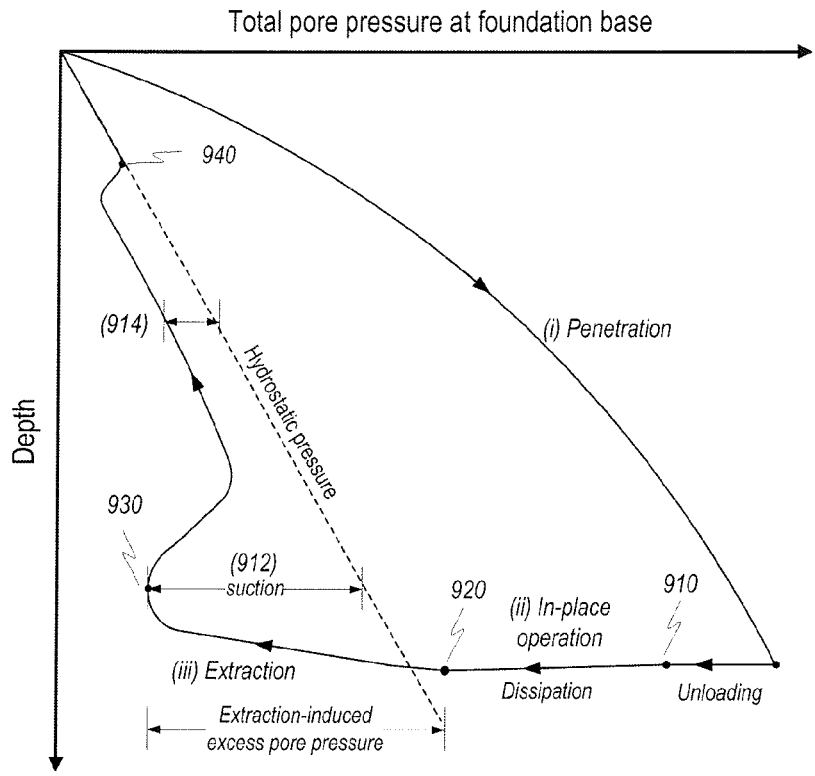
FIG. 9A illustrates the behaviour of soil pore pressure below the lower surface of the footing without the use of the above extraction systems, whilst

General behavior of pore water pressure below the lower surface of the footing/foundation 105 is described in FIG. 9A. In general, the water in the pores of the surrounding soil is known as pore water and the pressure within which is often referred to as pore pressure. The induced suction 912 is defined as negative excess pore pressure with respect to the hydrostatic pressure at the base of the footing or foundation 105. This negative excess pore pressure is induced by the extraction of the footing/foundation. Hydrostatic pressure can be referred as the pore pressure for any given depth where there is no water flow. FIG. 9A schematically illustrates a typical behavior of the pore pressure below the foundation base 114 throughout the entire operational stages of (i) penetration, (ii) in-place operation and (iii) extraction. The hydrostatic pressure corresponding to penetration depth of the footing/foundation base is also shown assuming it starts from zero at the seabed level. Experimental studies on the present invention have shown that a portion of the extraction-induced drop in pore pressure in the soil surrounding the base of the foundation transforms into suction 912. For the same soil and loading conditions, the magnitude of suction 912 was found to depend on the pore pressure at the base prior to extraction of the footing/foundation. Referring again to FIG. 9A, the pore pressure at the base 114 increases during the penetration of the footing/foundation 105 into the seabed until the foundation stabilizes at stage 910. Thereafter, the pore pressure starts to dissipate during an extended operation period until it reaches a level proximal to the corresponding hydrostatic pressure at the base, as shown in stage 920. When the footing/foundation 105 is extracted at stage 920, the extraction-induced change in pore pressure transforms into suction 912. Continual uplift of the footing/foundation is required to overcome the ultimate suction at stage 930, followed by the residual suction and any remaining overlying soil resistance 914 until the footing/foundation is fully extracted at stage 940.

Figure 9B:
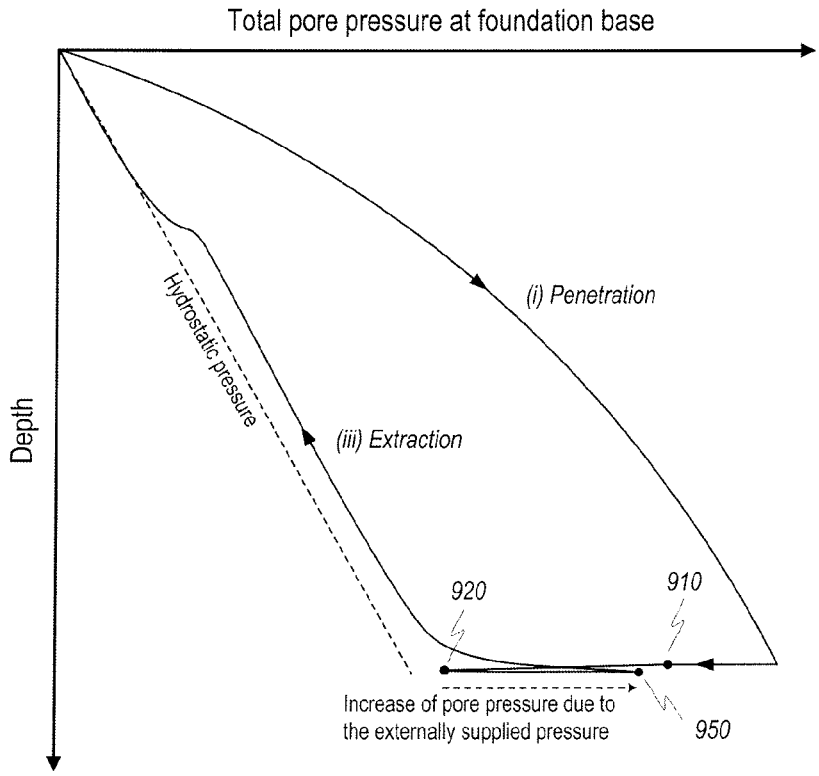
FIG. 9B illustrates the behaviour of soil pore pressure with the use of the above extraction systems.

The present invention improves the extraction of the footing or foundation 105 by increasing the pore pressure at the base 114 by supplying pressurized fluid 140, such as water or compressed air, throughout the extraction process to compensate for the suction 912 that develops at the base. As such, an external pressurized fluid needs to be supplied to the base of the footing to build up the pore pressure of the soil at the base external. Preferably, the pore pressure at the base builds up to the maximum level as shown in stage 950 of FIG. 9B when extraction starts. This provides for an initial supply of pressurized fluid to infiltrate the base external-soil interface to form a fluid film or layer which in turn serves to compensate for the negative excess pore pressure (suction 912) that is induced during the footing extraction process.

In a conventional mobile rig, the extraction of a leg of the rig by generating buoyancy of the rig's platform may be sustained for as long as two weeks or even two months in some extreme cases. An advantage of the extraction system of the present invention is that the extraction period of a mobile rig is significantly reduced since the pulling out rate is now proportional to the volume of fluid 140 being pumped in to fill the cavity left by the uplifted footing.

While specific embodiments have been described and illustrated, it is understood that many changes, modifications, variations and combinations thereof could be made to the present invention without departing from the scope of the present invention. For example, a spudcan 110 is used in the above description to illustrate a footing 105 of a marine structure; a footing can be formed of other shapes, such as a pyramid shape, that provide a large base to bear on the bed of a body of water. In another example, the footing can be a caisson and pressurized fluid is supplied to reduce suction induced therein when an uplifting force is applied to the caisson for its extraction.

What is claimed is:

1. An extraction system for removing a removable footing of a marine structure, said extraction system comprising:

a pump for supplying pressurized fluid to a chamber disposed in said footing; and a plurality of spaced apart outlets associated with the chamber such that the outlets are formed on a base of said footing that bears on the marine floor on which the marine structure is supported;

wherein each outlet has a porous member disposed across its opening, said porous member has a predetermined porosity and a predetermined surface area, such that the pressurized fluid is operable to exude out of the surface area of the porous member, without fluidizing or channeling the soil beneath the footing, to form a film or layer of pressurized fluid between the base external of the footing and the soil for reducing negative soil excess pore pressure when an uplifting force is applied to the footing during extraction of the marine structure, thereby easing the induced suction at the base of the footing and expediting removal of the marine structure.

2. An extraction system according to claim 1, wherein said chamber comprises a plurality of chambers.

3. An extraction system according to claim 2, wherein each chamber is formed inside the base surface of said footing.

4. An extraction system according to claim 2, wherein each chamber is formed outside the base surface of said footing.

5. An extraction system according to claim 1, wherein said pump feeds pressurized fluid into the chamber via a pipe or plurality of pipes.

6. An extraction system according to claim 1, wherein said pressurized fluid is water or air.

7. An extraction system according to claim 1, wherein said pump is operable to supply pressurized water to a pressure of up to about 100 bar (1500 psi).

8. An extraction system according to claim 1, wherein an aggregate area of the plurality of outlets ranges from about 1% to about 10% of the base surface area of said footing.

9. An extraction system according to claim 1, wherein said porosity of said porous member varies through a thickness of said porous member from large porosity on an inside face facing the chamber to small porosity on an outside facing the surrounding soil.

10. An extraction system according to claim 9, wherein said varying porosity is formed by integrally bonding separate layers of porous materials together.

11. An extraction system according to claim 1, wherein the porous member is made from any one of the following: metallic wire mesh; sintered metal powder; ceramic; sand-in-epoxy matrix; and sintered plastic.

12. An extraction system according to claim 11, wherein layers of the metallic wire mesh are stacked together and bonded or welded to form an integral porous member with open pore structure.

13. An extraction system according to claim 11, wherein the porous member is reinforced.

* * * * *